US006827406B2

(12) United States Patent
Marini

(10) Patent No.: US 6,827,406 B2
(45) Date of Patent: Dec. 7, 2004

(54) ARMREST SUPPORT

(76) Inventor: Conrad M. Marini, 241 Hanlan Road, Unit 4, Woodbridge, Ontario (CA), L4L 3R7

( * ) Notice: Subject to any disclaimer, the term of this patent is extended or adjusted under 35 U.S.C. 154(b) by 0 days.

(21) Appl. No.: 10/714,973

(22) Filed: Nov. 18, 2003

(65) Prior Publication Data

US 2004/0095008 A1 May 20, 2004

(51) Int. Cl.[7] ..... A47C 7/54
(52) U.S. Cl. ..... 297/411.36; 297/411.37
(58) Field of Search ..... 297/411.35, 411.36, 297/411.37, 411.31, 411.2, 411.38; 248/118, 118.3

(56) References Cited

U.S. PATENT DOCUMENTS 5,599,067 A * 2/1997 Schuelke et al. ..... 297/411.35
6,139,107 A * 10/2000 Lee ..... 297/411.36
6,209,961 B1 * 4/2001 Chen ..... 297/411.36
6,296,312 B1 * 10/2001 Congleton et al. ..... 297/411.35
6,394,553 B1 * 5/2002 McAllister et al. .... 297/411.36
6,460,932 B1 * 10/2002 Kopish et al. ..... 297/411.36
6,502,904 B1 * 1/2003 Hansen ..... 297/411.35
6,619,746 B2 * 9/2003 Roslund et al. ..... 297/411.36
6,702,386 B2 * 3/2004 Davis et al. ..... 297/411.35
2002/0190561 A1 * 12/2002 Phillips et al. ..... 297/411.35

* cited by examiner

*Primary Examiner*—Milton Nelson, Jr.

(57) ABSTRACT

An adjustable in height armrest comprises a tubular armrest column and a tubular armrest carrier telescopes on the armrest column. An arm support is secured to the top of the armrest carrier. The armrest column is releasably lockable at various heights and angles using a releasable locking system. The releasable locking system includes two locking members carried by the armrest carrier and lockable with the armrest column spring biased lock release member is slidable on the armrest carrier and moves between a locked position and a release position against the spring bias. In the release position the locking members are free to move outwardly allowing movement of the armrest carrier and the armrest column for both height and angular adjustment thereof.

18 Claims, 7 Drawing Sheets

ARMREST SUPPORT

FIELD OF THE INVENTION

The present invention relates to armrest supports and in particular to armrest support which are adjustable in height and allow adjustment of the angle of the armrest support.

BACKGROUND OF THE INVENTION

Many different types of adjustable armrest support have been proposed where the armrest is adjustable in height as well as angle. Some of these structures have a single lock mechanism that allows adjustment of both height and angle by release of a single lever.

A common approach is to use a lock arrangement having at least one pin receivable in any hole of a series of holes for locking of the armrest column at a particular height. With this type of structure, there is a separate armrest angle adjustment provided at the top of the armrest support for varying the angle of the armrest relative to the axis of the column support. A lever and control linkage arrangement allows for release of the lock mechanism to allow adjustment of the height of the column support.

U.S. Pat. No. 5,749,628 discloses a spring loaded pawl member engageable with a ratchet surface provided on the exterior of a column to allow adjustment of the height of the arm. The pawl is spring loaded against the ratchet surface and is moveable by means of a lever to a release position. The angle adjustment of the arm is provided by a separate locking arrangement provided at the top of the column. The adjustable arm of U.S. Pat. No. 5,749,628 uses a support column of a rectangular configuration with the arm holder slideable on this rectangular bar configuration. With this arrangement all adjustment of the arm must occur at the top surface of the adjustable arm support.

There are a series of adjustable height armrest supports which have a first lock arrangement for adjusting and locking the height of the armrest and a spring detent type lock arrangement provided at the upper surface of the column. Basically the arms are free to assume a different angular position if sufficient force is applied to move the spring detent from one locking position to a different locking position.

It is desirable to provide a simple height adjustable armrest support which also accommodates adjustment in the angle of the armrest. Furthermore, it would be desirable to provide such a system which can be adapted to accommodate different mounting angles of the armrest relative to the chair seat. Thus the armrest can be angled slightly outwardly or inwardly as well as forwardly and rearwardly as necessary for a particular style of chair.

SUMMARY OF THE INVENTION

An adjustable in height armrest according to the present invention comprises a tubular armrest column, a tubular armrest carrier adapted to telescope relative to the armrest column for adjusting the height of the armrest, an arm support located on top of said armrest carrier and a releasable locking system for securing the armrest column relative to the armrest carrier in one of a series of positions where each position defines a fixed height of the armrest and a fixed angular orientation of the arm support relative to a longitudinal axis of the armrest column. With this arrangement, the height of the armrest and the angle of the arm support relative to the longitudinal axis of the armrest column are adjustable. The releasable locking system includes two locking members carried by the armrest carrier and releasably engageable with locking recesses provided in an outer surface of the armrest column on opposite sides thereof. The locking system further includes a lock release member having a spring bias urging said lock release member to a locking position, said lock release member in said locking position forcing said locking members into engagement with said locking recesses to secure said armrest at a fixed height and angle. The lock release member when moved against the spring bias to a release position frees the locking members to move and disengage said locking recesses thereby allowing adjustment of the height and angular position of the arm support about the axis of the tubular armrest column.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION IN WHICH

Figure 2:
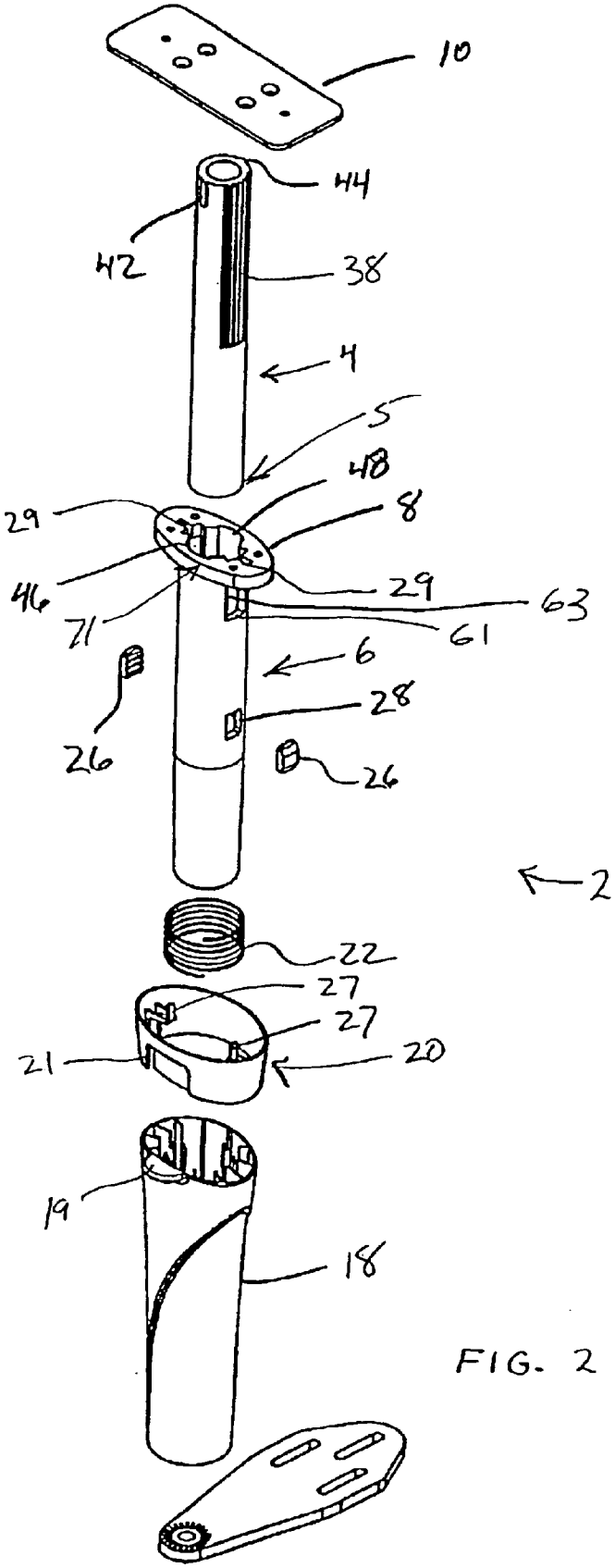
FIG. 2 is an exploded perspective view showing different components of the armrest.
Figure 1:
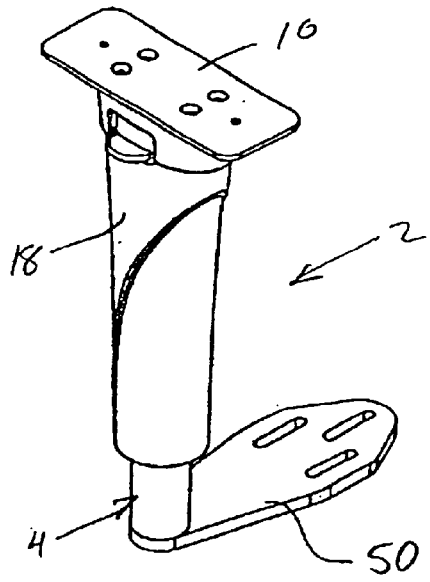
FIG. 1 is a perspective view of the adjustable armrest column.
Figure 3:
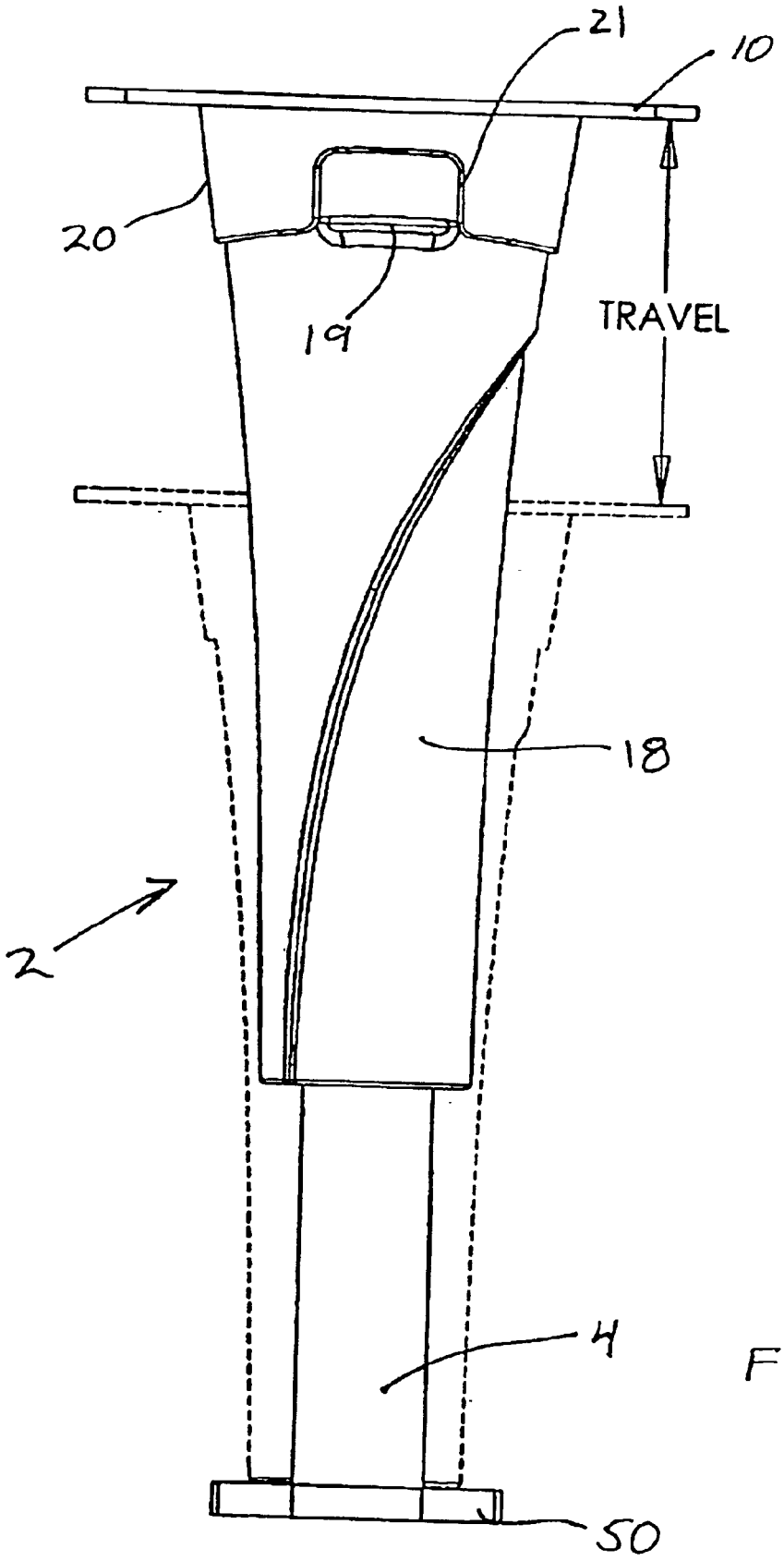
FIG. 3 is a side view showing the height adjustability range of the armrest column.

The height adjustable armrest 2 as shown in FIGS. 1 and 2 has a tubular armrest column 4 which slidably receives to the exterior thereof the tubular armrest carrier 6. The tubular armrest carrier 6 includes at an upper surface the top flange 8 which mechanically receives the arm support 10. The tubular armrest carrier 6 is only partially rotatable about the axis of the tubular armrest column due to the outwardly projecting keys 42 and 44 being limited within key slots 46 and 48 provided in the armrest carrier 6.

The armrest carrier 6 includes opposed ports 28 for receiving the opposed locking members 26. The locking members 26 when forced inwardly against the armrest column 4 will engage the locking surfaces 38 and 40 provided on the armrest column 4. (See FIG. 6)

Figure 4:
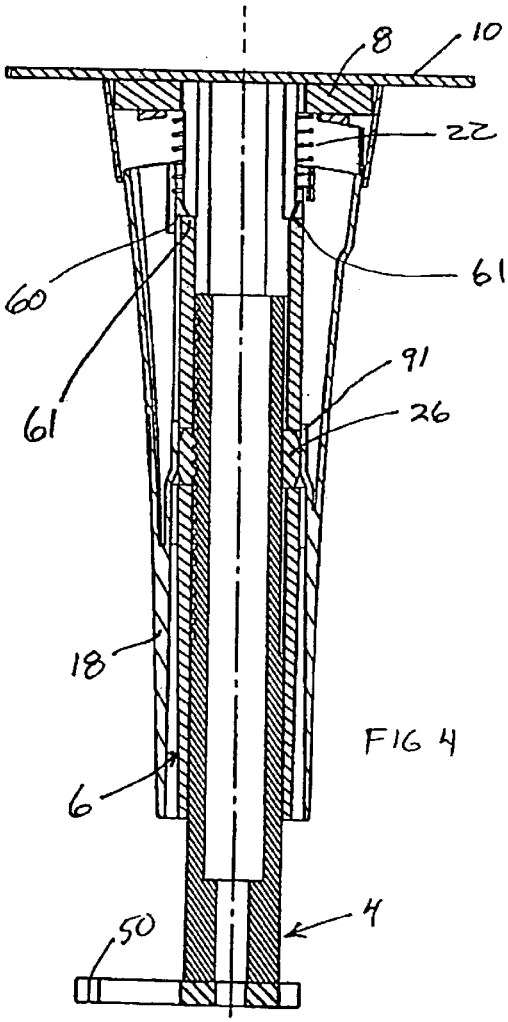
FIG. 4 is a sectional view through the armrest column.
Figure 5:
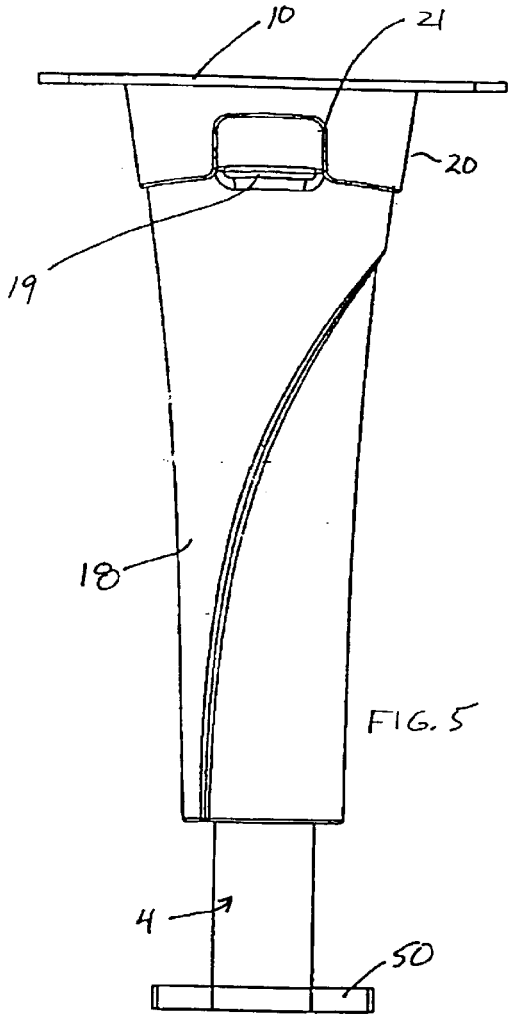
FIG. 5 is a side view of the armrest column.

A movable lock sleeve 18 cooperates with the collar 20 which is fixed to the top flange 8 of the armrest column 4. The spring 22 forms a bias urging the movable lock sleeve 18 to a locked position as generally shown in FIG. 4. The lock sleeve includes a stop tab 60 forming the bottom position of the lock sleeve relative to the armrest column 4. Movement of the movable cover 18 by the user forcing the tab 19 to move within the slot 21 of the cover column 20, allows the opposed locking members 26 to move outwardly.

In the locked position of FIG. 4 the cover 18 is pressing on the outside surface of the locking members 26 and forcing them into engagement with the locking surfaces 38 and 40 of the armrest column 4. The slight movement of the cover 18 upwardly releases contact of the cover with the locking members which can move marginally outwardly to a clear position within the enlarged cavity 65. The locking members 26 are maintained within the ports 28 of the tubular armrest carrier 6 by the enlarged cavity 65. Release of the tab 19 forces the lock sleeve 18 to move downwardly and forces the locking members 26 into engagement with the locking surfaces of the armrest column 4. The locking surfaces 38 and 40 are oversized in width to correspond to any angular adjustment of the armrest column. Thus movement of the lock sleeve 18 upwardly allows both telescopic movement of the armrest column 4 relative to the armrest carrier 6 and it also allows limited angular movement of the carrier 6 relative to the axis of the column 4. This movement is limited due to the cooperation of outwardly projecting keys 42 and 44 with key slots 46 and 48.

Figure 12:
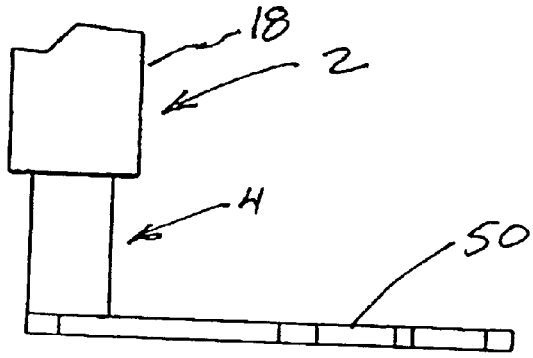
FIGS. 12 through 14 are partial side views showing different mounting plates secured to the bottom of the tubular armrest column.
Figure 13:
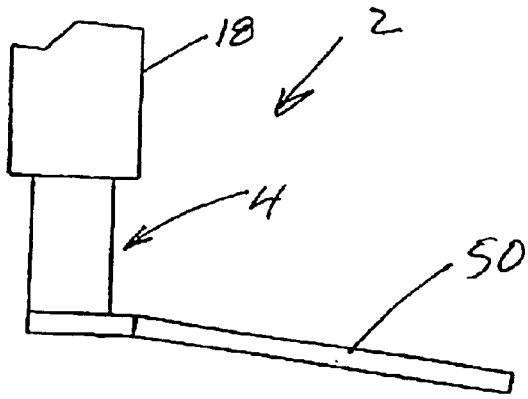
Figure 14:
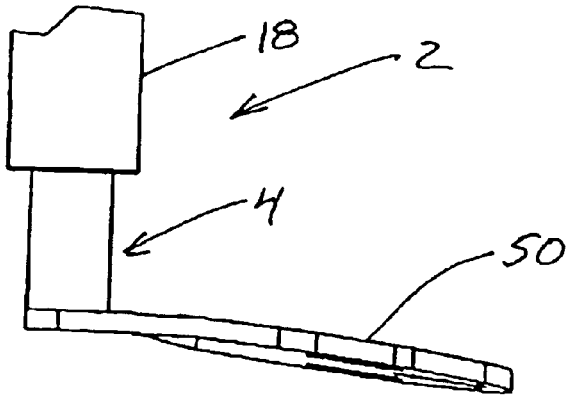

An upholstered or plastic armrest can be attached to the plate 10. In addition, the base of the height adjustable armrest 2 is the mounting plate 50 which is secured to the lower end 5 of the tubular armrest column 4. The angle of the plate relative to the axis of the column 4 can change and as shown in FIGS. 12 and 13 the shape of the plate can change to accommodate different chair seats. This also allows the angle of the column from side to side as well as front to back to vary according to the particular plate. This is a convenient approach to accommodate different chair designs using the same height adjustable armrest assembly.

In the height adjustable armrest 2 of FIGS. 2 and 4 the locking surface 38 is a series of vertical ribs, which are engaged, by a series of vertical ribs or projections on the corresponding locking member 26. The opposite locking surface 40 is a series of horizontal ribs and these engage the horizontal ribs of the locking member 26. As can be appreciated one of these locking members limits and locks against angular movement of the armrest column 4 relative to the armrest carrier 6 and the opposite locking member locks the height adjustment.

Figure 8B:
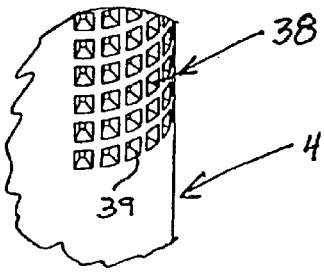
FIG. 8*b* is a partial perspective view of the locking surfaces on the armrest column.
Figure 8A:
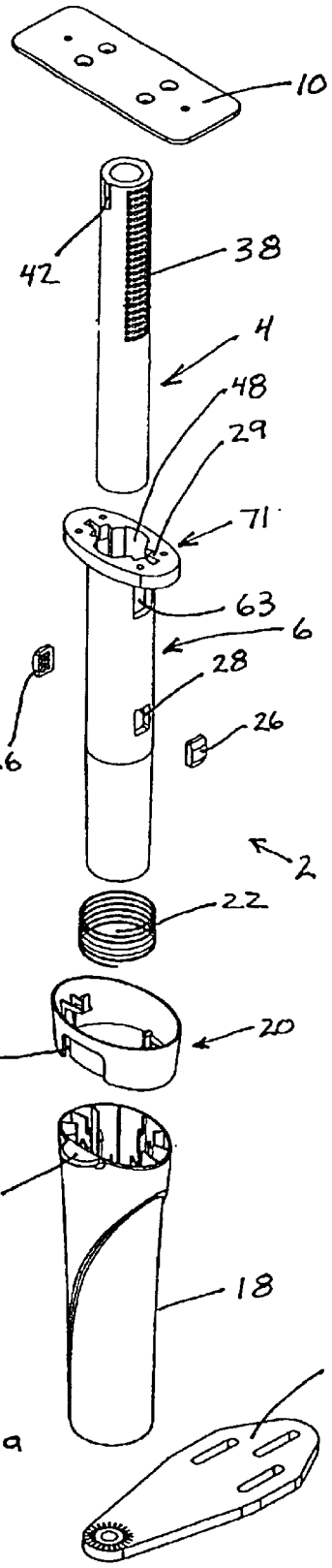
FIG. 8*a* is an exploded assembly drawing of the armrest column of FIG. 7.
Figure 8C:
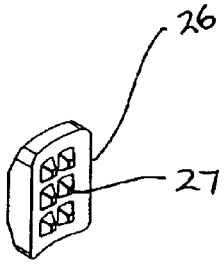
FIG. 8*c* is a perspective view of one of the locking members.

The series of FIGS. 6, 7 and 8 show a different arrangement for locking of the height adjustable armrest. In this case, the locking surfaces 38 and 40 provided on the armrest column 2 are a series of inwardly extending pyramid shaped cavities 39. The locking members 26 include a series of pyramid type projections 27 with each locking member 26 having a series of vertically aligned pyramids as well as a series of adjacent horizontal pyramids. These pyramid projections form both rows and columns of projections. This type of locking member can also be used with the arrangement of FIG. 1. The pyramid projections align and nest with the pyramid shaped cavities on the armrest column. These projections form an automatic aligning mechanism assuring a smooth and easily controlled height adjustment of the armrest column. These surfaces provide small cam surfaces urging the locking members outwardly when the carrier has been moved to the clear position. The carrier in the locked position maintains a positive connection with little tolerance. Thus the user is able to fix the height and angle of the armrest in a host of positions while maintaining an acceptable tolerance.

Figure 6A:
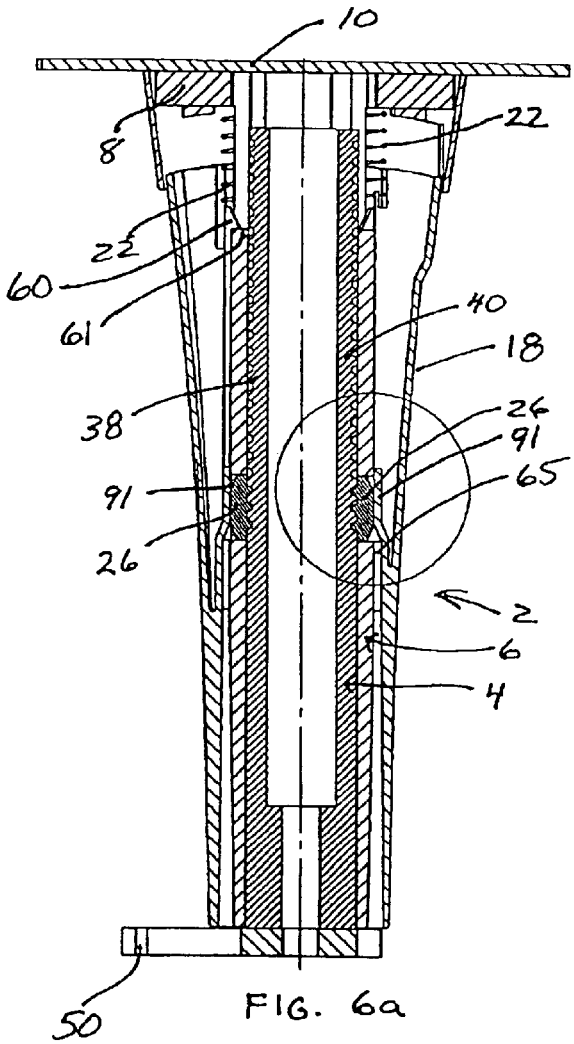
FIGS. 6*a* and 6*c* are a sectional views through the armrest column showing the tubular armrest column and locking surfaces provided thereon.
Figure 6C:
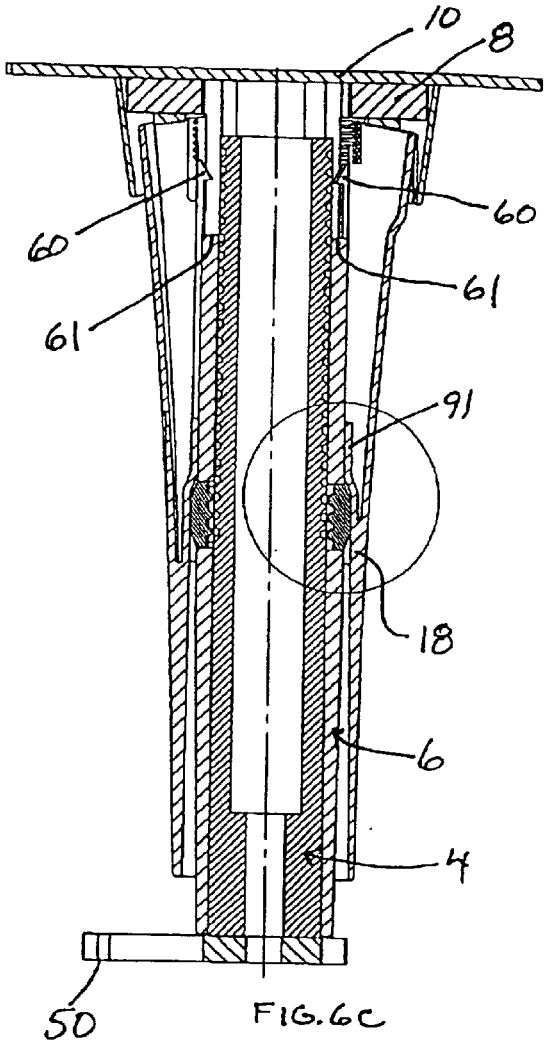
Figure 6B:
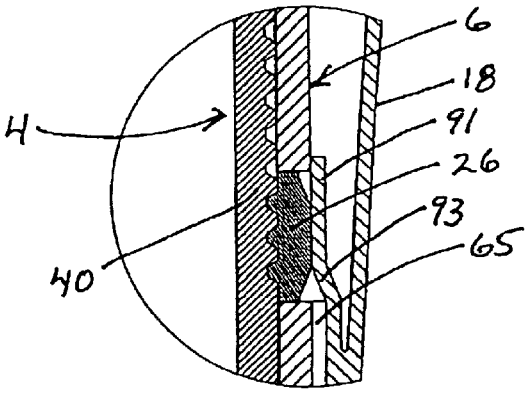
FIGS. 6*b* and 6*d* are enlarged views of the locking and release of the armrest.

In FIGS. 6*a* and 6*b* the adjustable armrest 2 is in a locked position. The locking members 26 are in engagement with the locking surfaces 38 and 40 on the armrest column 4. The armrest carrier 6 is therefore in a fixed height angle position relative to the armrest column 4. The arm support 10, as it is secured to the top flange 8 of the armrest carrier 6 is similarly at a fixed height and angle.

The moveable lock sleeve 18 is biased by the spring 22 to a locked position. This locked position is defined by the restricted cavity 91 forcing locking members 26 into engagement with locking surfaces 38 and 40.

The restricted cavity 91 includes a cam or transition surface 93 leading to the enlarged cavity 65.

Figure 6D:
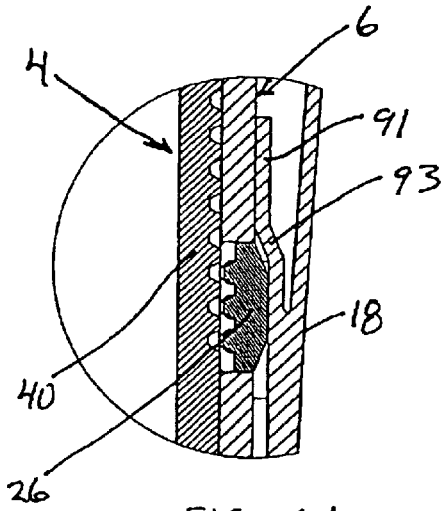

The lock sleeve 18 has been moved to the release position in FIGS. 6*c* and 6*d* such that the locking members 26 have moved outwardly into the cavity 65 and are clear relative to the locking surfaces 38 and 40. Movement of the arm support 10 to adjust the height or angle will also assist in the locking members moving to the release position.

Release of the locking sleeve 18 causes restricting cavity 91 to engage the locking members 26 and provide an inward bias. This inward bias encourages the pyramid projections 27 of the locking member to engage the pyramid cavities 39 of the locking surfaces and align as necessary to assume a locked position. As can be appreciated the armrest carrier 6 and the lock sleeve 18 move together during both height and angular adjustment of the armrest 2.

Figure 7A:
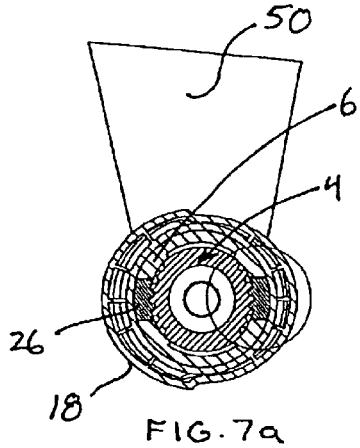
FIG. 7*a* is a sectional view through the locking members of the armrest column of FIG. 6.
Figure 7B:
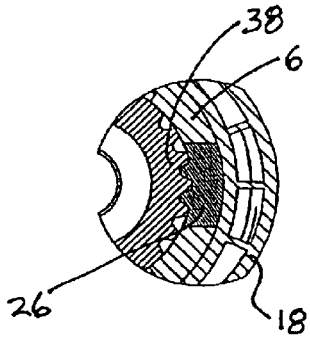
FIG. 7*b* is an enlarged view of the components within the circle of FIG. 7*a;*
Figure 9:
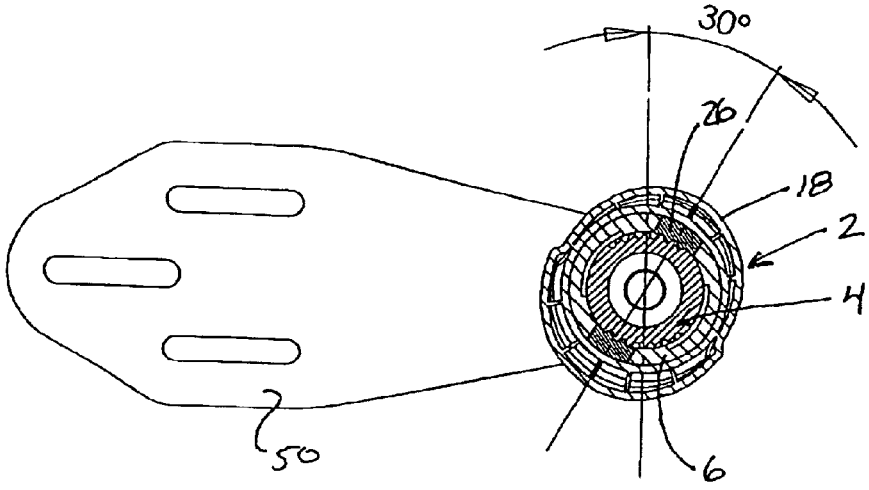
FIGS. 9 through 11 are sectional views through the locking members of the armrest column showing the angular adjustment thereof.
Figure 10:
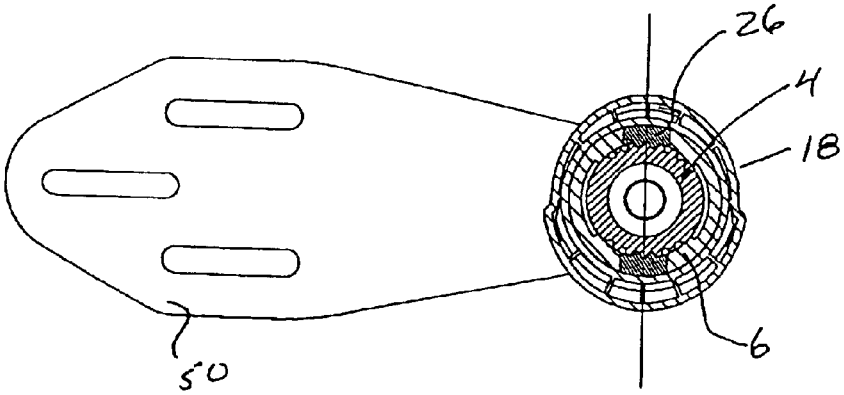
Figure 11:
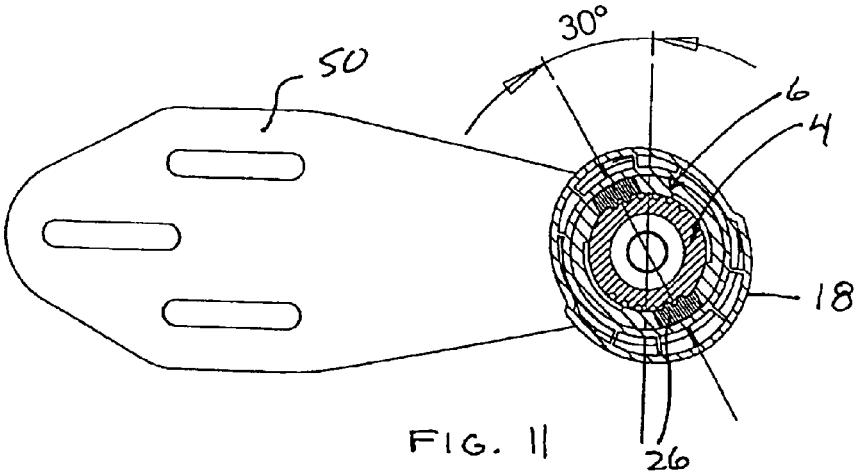

As shown in FIGS. 7*a* and 7*b* the cavity 91 is sized to force locking members 26 to fully engage the locking surfaces 38 and 40.

As shown in FIG. 8*a* the locking surfaces 38 and 40 are oversized in both height and width to allow for the maximum height adjustment as well as to allow for the maximum angular adjustment at all height positions. These locking surfaces accommodate a maximum rotation of the arm of approximately 60 degrees from a 30 degree outward angle to a 30 degree inward angle. With this arrangement a substantial surface of the carrier can be keyed i.e., a further 60 degrees for limiting the angular movement of the arm. With this arrangement there is still a substantial gap between the locking surfaces and the outwardly extending keys. Basically, the keys are located at 90 degrees from the centerline on the locking surfaces.

The adjustable height armrest allows for both angular and height adjustment in a relatively simple manner and by means of a single lock arrangement. The lock arrangement when released automatically moves to a locked position.

Assembly of the armrest 2 can be appreciated from the exploded perspective views of FIGS. 2 and 8*a*. The armrest column 4 is inserted downwardly through the armrest carrier 6 and the outwardly projecting lugs 42 and 44 will bottom out on the bottom of slots 46 and 48 within the armrest carrier 6. The locking surfaces 38 and 40 of the column 4 are with the ports 28 of the carrier 6 and the locking members 26 are inserted. The compression spring 22, collar 20 and lock sleeve 18 are placed on the carrier 6. The collar 20 includes spring tabs 27 which have a snap fit with parts 29 of the carrier to lock the collar to the carrier. The lock sleeve 18 has internal lock tabs 60 which engage shoulders 61 of parts 63 in the carrier. The mounting plate 50 is mechanically secured to the bottom end 5 of the armrest support column. The arm support plate 10 is secured to the outwardly extending flange 71 of the carrier 6 and traps the support column 4 to the carrier 6.

Preferably the armrest support column 4 and the armrest carrier 6 are made from a reinforced plastic material. Similarly collar 20 and locking sleeve 18 can be of a molded plastic. The outer shape of the locking sleeve 18 and the collar 20 can vary to provide different visual designs. The longitudinal cavity of the armrest carrier 6 includes bearing surfaces for maintaining alignment with the support column 4.

The adjustable armrest 2 provides excellent height and angle adjustment and can easily be modified for many different chair designs. The armrest has proven to be reliable in operation and has high structural integrity.

Although various preferred embodiments of the present invention have been described in detail, it will be appreciated by those skilled in the art that variations may be made without departing from the spirit of the invention or the scope of the appended claims.

What is claimed is:

1. An adjustable in height armrest comprising a tubular armrest column, a tubular armrest carrier adapted to telescope relative to said armrest column for adjusting the height of the armrest, an arm support located on top of said armrest carrier, and a releasable locking system for securing said armrest column and said armrest carrier in one of a series of positions where each position defines a fixed height of said armrest and a fixed angular orientation of said arm support relative to a longitudinal axis of said armrest column whereby the eight of said armrest and the angle of said arm support relative to the longitudinal axis of said armrest column is adjustable; said releasable locking system including two locking members carried by said armrest carrier and releasably engagable with locking recesses provided in an outer surface of said armrest column on opposite sides thereof, said locking system further including a spring biased lock release member biased to a locking position causing said locking members to secure said armrest at a fixed height and angle, said lock release member when move against said spring bias to a release position freeing said locking members to move outwardly to a position clear of said armrest column and allowing adjustment of the height and angle of said arm support.

2. An adjustable in height armrest as claimed in claim 1 wherein said recesses provided in the outer surface of said tubular armrest column are a series of vertical ribs on one side of said column and a series of horizontal ribs on the opposite side of said column, said horizontal ribs defining a series of vertical height adjustments of said armrest and said series of vertical ribs defining a series of angular adjustments of said arm support relative said armrest column.

3. An adjustable in height armrest as claimed in claim 2 wherein said armrest carrier and said armrest column have keyed surfaces which cooperate to maintain the angular adjustment of said arm support within a limited angular range.

4. An adjustable in height armrest as claimed in claim 3 wherein said limited angular range is less than 100°.

5. An adjustable in height armrest as claimed in claim 3 wherein said keyed surfaces include a notched slot in an interior surface of said armrest carrier which receives and limits the angular movement of a key provided on an outer surface of said armrest column.

6. An adjustable in height armrest as claimed in claim 1 wherein said recesses provided in the outer surface of said tubular armrest column are two opposed vertical columns of recesses and where each column of recesses is defined by a series of horizontally spaced recesses and a series of vertically spaced recesses where a width of each column defines the extent of adjustment of the angular position of said arm support relative to said armrest column and a height of the column of recesses generally determines the height adjustment of said arm rest support relative to said armrest column.

7. An adjustable in height armrest as claimed in claim 6 wherein said recesses are each of a shape to receive pyramid shape projections provided on said locking members.

8. An adjustable in height armrest as claimed in claim 7 wherein said pyramid projections of each locking member are vertically and horizontally space which engage only a limited portion of said vertically and horizontally spaced recesses on said armrest column.

9. An adjustable in height armrest as claimed in claim 8 wherein said pyramid projections of each locking member is at least 4 adjacent pyramid projections positioned to engage at least 4 adjacent recesses of said armrest column with said 4 adjacent pyramid projections being aligned vertically and horizontally to define a lower pair of pyramid projections and an upper pair of pyramid projections.

10. An adjustable in height armrest as claimed in claim 8 wherein each locking member has at least 3 rows of horizontally adjacent pyramid projections.

11. An adjustable in height armrest as claimed in claim 10 wherein each row of horizontal adjacent pyramid projections are defined by two pyramid projections.

12. An adjustable in height armrest as claimed in claim 11 wherein each pyramid projection extends into a corresponding recess of said armrest column less than one quarter of an inch.

13. An adjustable in height armrest as claimed in claim 11 wherein each lock member moves less than one quarter of an inch from a locked position to a release position.

14. An adjustable in height armrest as claimed in claim 1 wherein each locking member is received in a port through said armrest carrier and is movable in a direction perpendicular to a longitudinal axis of said armrest carrier, each locking member including an exterior cam surface projecting beyond said armrest carrier which is releasably engagable with said spring biased lock release member, said spring based lock release member in a locking position engaging said cam surface of each locking member and maintaining each locking member in engagement with said armrest column.

15. An adjustable in height armrest as claimed in claim 14 wherein said spring biased lock release member is a tubular member slidable on said armrest carrier.

16. An adjustable in height armrest as claimed in claim 15 wherein said tubular member includes a recessed skirt portion on a lower end thereof which in the locking position of said release member is below said locking members, said release member being movable upwardly to position said recessed skirt portion opposite said locking members and allowing said locking members to move to a release position while still being maintained in said ports of said armrest carrier.

17. An adjustable in height armrest as claimed in claim 1 including a plate member secured a bottom end of said armrest column and wherein said plate includes means for securing thereof to a chair.

18. An adjustable in height armrest as claimed in claim 17 wherein said plate includes a chair securing portion and an armrest column securing portion disposed at an angle to said chair securing portion.

* * * * *